US010023276B1

(12) United States Patent
Sharrer

(10) Patent No.: US 10,023,276 B1
(45) Date of Patent: Jul. 17, 2018

(54) CANOE OUTRIGGER WITH BUILT-IN STORAGE CAPACITY

(71) Applicant: Nicholas Carl Sharrer, Wasilla, AK (US)

(72) Inventor: Nicholas Carl Sharrer, Wasilla, AK (US)

( * ) Notice: Subject to any disclaimer, the term of this patent is extended or adjusted under 35 U.S.C. 154(b) by 0 days.

(21) Appl. No.: 15/421,714

(22) Filed: Feb. 1, 2017

(51) Int. Cl.

| | |
|---|---|
| ***B63B 17/00*** | (2006.01) |
| ***B63B 43/04*** | (2006.01) |
| ***B63B 35/71*** | (2006.01) |
| ***B63B 1/12*** | (2006.01) |
| ***B63B 25/00*** | (2006.01) |
| *B63B 3/56* | (2006.01) |
| *B63B 3/38* | (2006.01) |

(52) U.S. Cl.
CPC ..... *B63B 43/04* (2013.01); *B63B 1/12* (2013.01); *B63B 25/002* (2013.01); *B63B 35/71* (2013.01); *B63B 3/38* (2013.01); *B63B 3/56* (2013.01); *B63B 2035/715* (2013.01)

(58) Field of Classification Search
CPC B63B 43/04; B63B 35/71; B63B 1/12; B63B 25/002
USPC ..... 114/61.1, 123, 363
See application file for complete search history.

(56) References Cited

U.S. PATENT DOCUMENTS

| | | | | | |
|---|---|---|---|---|---|
| 1,663,888 | A * | 3/1928 | Osten | B63B 43/04 | 114/123 |
| 2,544,599 | A * | 3/1951 | Keelen | B63B 43/14 | 114/123 |
| 4,807,551 | A * | 2/1989 | Ace | B63B 1/121 | 114/123 |
| 5,619,950 | A * | 4/1997 | Ikeda | B63B 35/731 | 114/363 |
| 6,050,210 | A * | 4/2000 | Grzybowski | B63B 43/14 | 114/123 |
| 8,047,153 | B2 * | 11/2011 | Wood | B63B 35/665 | 114/292 |

* cited by examiner

*Primary Examiner* — Stephen P Avila
(74) *Attorney, Agent, or Firm* — Michael J. Tavella

(57) ABSTRACT

A canoe outrigger with built-in, covered, storage capacity. Unlike a typical pontoon type outrigger, this device is a miniature canoe form that has an open interior. The top of the outrigger has three doors allowing for storage and access within the form that holds many supplies, such as camping and fishing gear, food, water and other items. The outrigger is connected to a canoe, or other small boat, by a pair of telescoping arms. Each arm has clamps that secure the arms the gunwales of the vessel. The other end of each arm is bolted into position on the outrigger. In this way, the outrigger is securely attached for use.

15 Claims, 8 Drawing Sheets

CANOE OUTRIGGER WITH BUILT-IN STORAGE CAPACITY

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to canoe outriggers and particularly to canoe outriggers with built-in storage capacity.

2. Description of the Prior Art

Outriggers or pontoons have been used for thousands of years to stabilize Polynesian natives' canoes. An outrigger is basically a floating element that is attached to a canoe (or other small watercraft) at some distance apart from the canoe. This floating element helps to maintain stability in heavy seas and surf typically encountered by the Polynesians. Over the years, others have incorporated the use of outriggers or pontoons to more modern vessels. Some examples of these designs are found in the following U.S. Pat. No. 3,593,684 teaches a catamaran that is a twin hulled boat in which, the twin hulls are connected by a collapsible frame. U.S. Pat. No. 4,512,277 teaches a pair of adjustable pontoons for a canoe. The outrigger arms are adjustable to allow for attachment to different height canoes. U.S. Pat. No. 4,624,209 teaches a catamaran boat that is made of two canoes that are planked over to form a deck. The deck has hatches to access the canoes for storage. A superstructure is built atop the deck to allow the catamaran to be used. U.S. Pat. No. 4,807,551 teaches a more traditional outrigger design in which a pontoon is attached to a canoe using a pair of outrigger arms. The pontoon is a solid float. U.S. Pat. No. 5,988,090 teaches a set of pontoons that are deployed on the sides of a canoe. A battery operated motor system is used to raise and lower the pontoons as desired. U.S. Pat. No. 6,345,582 teaches an outrigger device for a canoe. In this design, the outrigger has a pontoon that allows a platform to be installed between the pontoon and a canoe. The platform allows a stable base to attach a chair for fishing, for example. U.S. Pat. No. 6,725,798 teaches a platform that extends between two canoes. The platform can be used for many purposes, such as supporting a tent or a table and chairs. Finally, published application No. US20060102063A1 teaches a platform to a kayak. The platform is attached to the kayak and has a pontoon that provides lateral stability. The platform allows a user to stand or sit outside of the kayak during fishing, for example.

While these devices are useful in their intended purposes, none provides a convenient, covered, sizable storage area for holding camping supplies and the like while canoeing.

BRIEF DESCRIPTION OF THE INVENTION

The instant invention solves this problem. It is a canoe outrigger with built-in, covered, storage capacity. Unlike a typical pontoon type outrigger, this device is a miniature canoe form that has an open interior. The top of the outrigger has three doors allowing for storage and access within the form. Bulkheads separate the three storage areas that hold supplies, such as camping and fishing gear, food, water and other items. The top of the bulkheads have slots to receive connector arms. The outrigger is connected to a conventional canoe (or other small boat) by a pair of telescoping arms. Each arm has small clamps that secure the arms to the gunwales of the vessel. The arms span the vessel to attach the outrigger to both sides of the vessel for greater stability. The other end of each arm has a member that aligns with the slots formed in the top of the outrigger. The member fits into the slots and is bolted into position. In this way, the outrigger is securely attached for use.

DETAILED DESCRIPTION OF THE INVENTION

Figure 1:
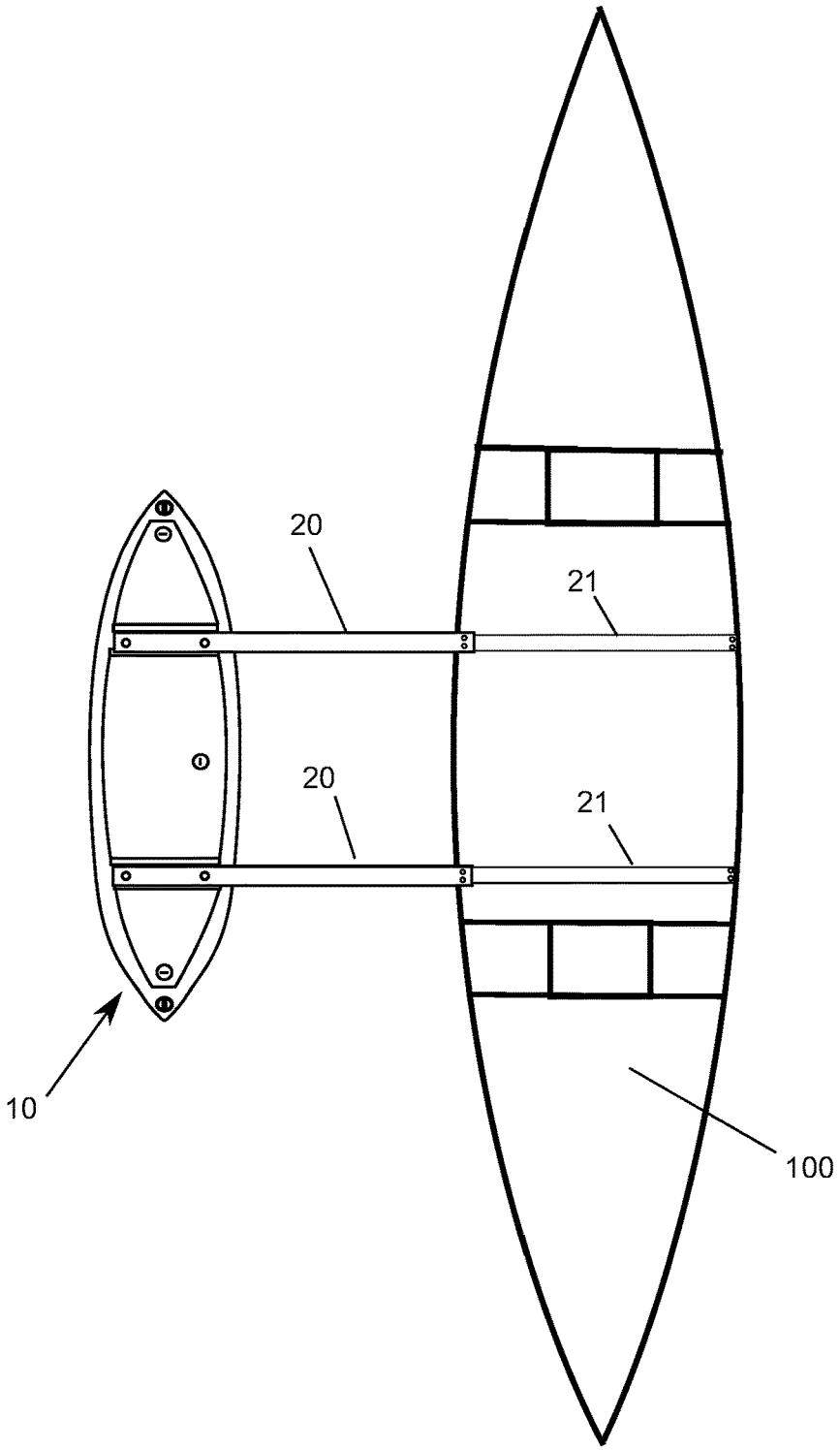
FIG. 1 is a top view of a canoe showing the outrigger attached.
Figure 2:
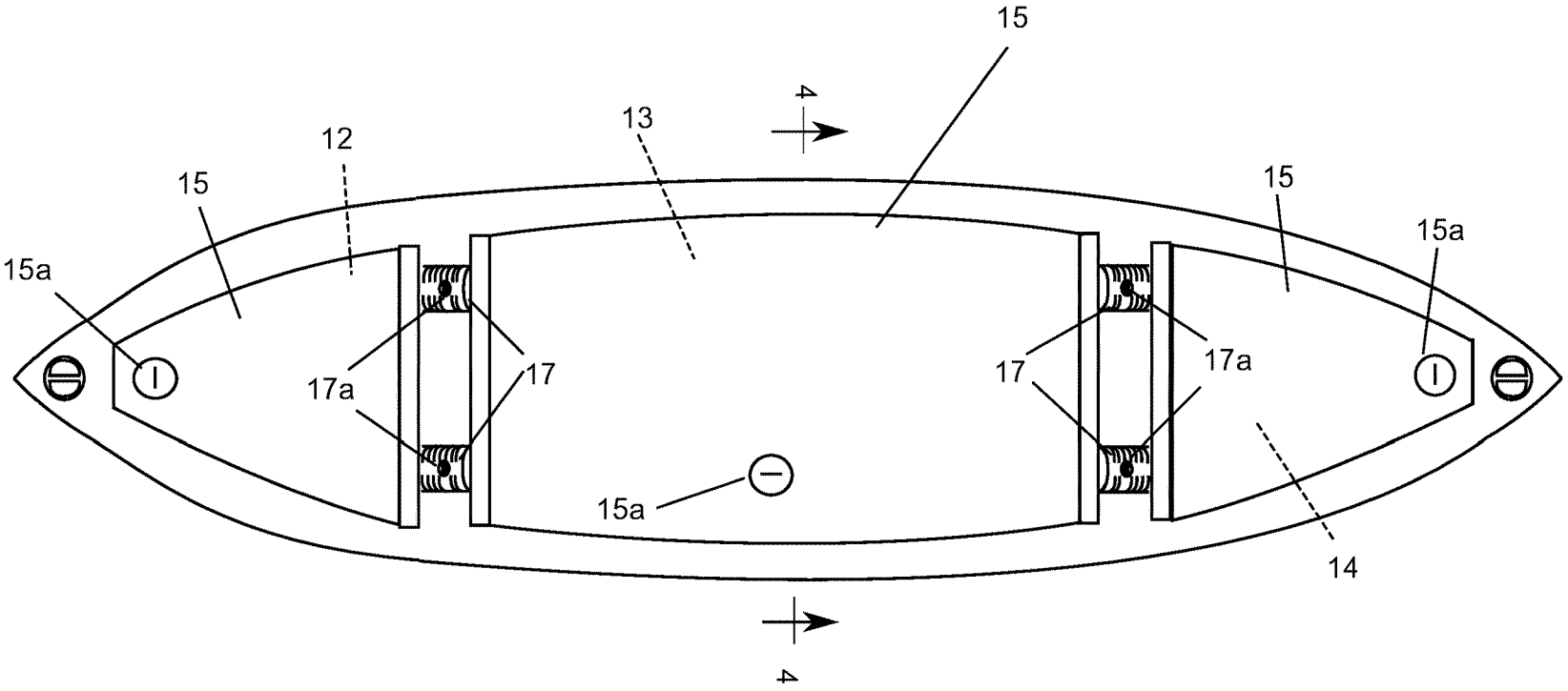
FIG. 2 is a top view of the outrigger with the storage compartment door closed.
Figure 3:
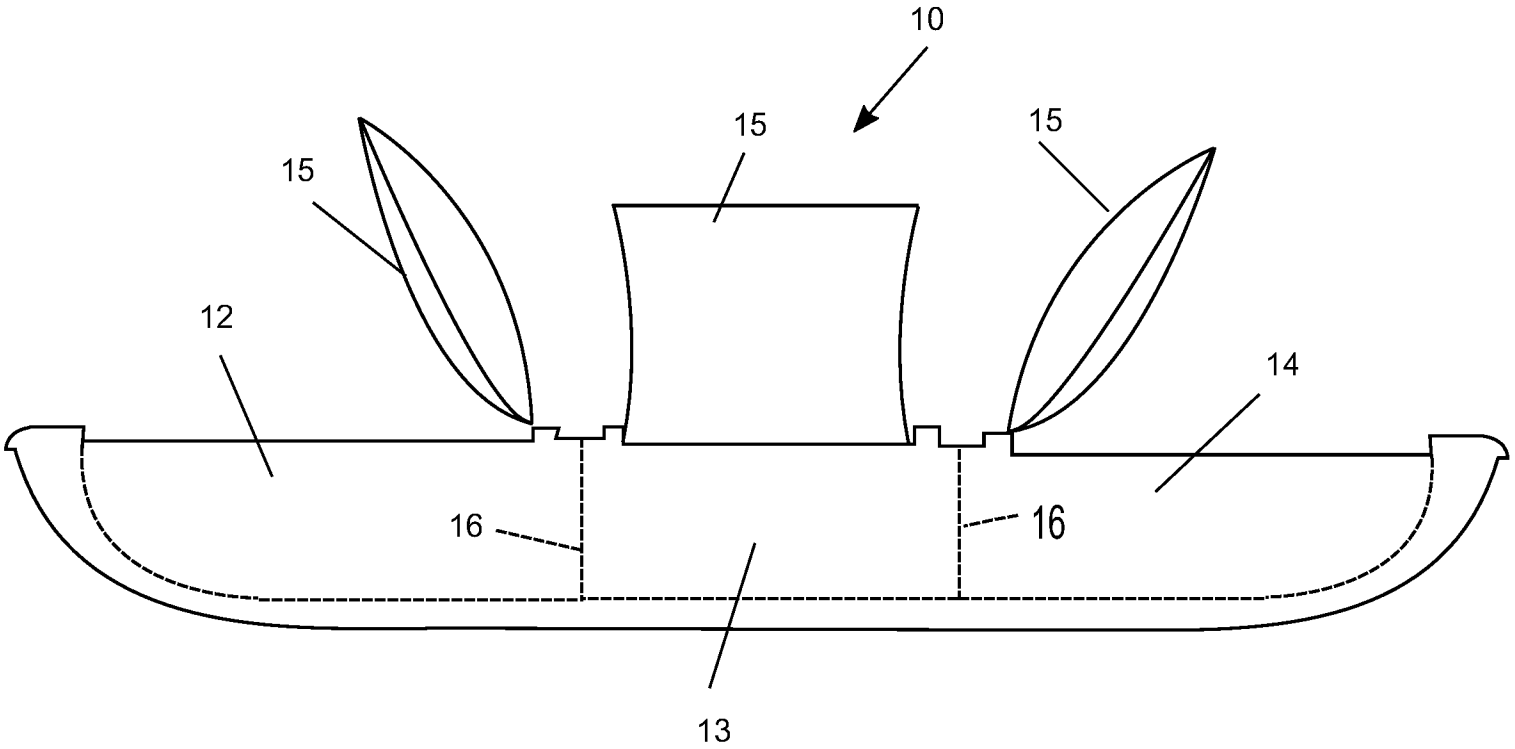
FIG. 3 is a right side view of the outrigger with the storage doors open.

Referring now to the drawings and especially FIGS. 1-3, the invention 10 is an outrigger that is attached to a vessel, such as a canoe 100 shown, or other small vessel. The outrigger 10 is attached to the vessel 100 by two connector arms 11 that have a connector portion 20 and an extension portion 21, as discussed below.

FIG. 1 shows the outrigger 10, the preferred size of which is six feet overall, as is shown compared to a 16 foot canoe. However, any reasonably sized similar vessel can be used with the device. These other vessels include, but are not limited to rowboats and skiffs.

As shown in FIGS. 1 and 2, the outrigger 10 has three covered compartments. Two at the ends of the device, 12 and 14 and a center compartment 13. Note that the compartments are covered with doors 15. Each door has a latch 15*a* and a hinge 15*b* as shown. The storage compartments are separated by bulkheads 16 (see also FIG. 5). The bulkheads provide a sturdy structure to attach the connector arms 11, as discussed below. Note that two recessed areas 17 are provided to receive the connector arms. Bolt holes 17*a* provided threaded receptacles to secure the bolts, and thus the connector arms, to the outrigger. As shown in FIG. 1, the connector portion of the connector arms 20 attaches to the outrigger. Two connector arms 11 are used, as shown. An extension portion, for each arm 21, extends across the canoe. Two connector blocks 22 (see FIGS. 6, 8 and 9) are used to attach the connector arms to the canoe (or other vessel). These connector blocks are tightened up against the gunwales on each side of the canoe, as discussed below. The connector arms are attached to both sides of the canoe to provide maximum stability.

FIG. 3 is a right side view of the outrigger with the storage doors open. Here, the outrigger 10 is shown with the storage doors 15 open. The doors 15 are provided with gaskets 15*a* to make the doors watertight. Note that the storage compartments 12, 13, and 14 are also shown.

Figure 4:
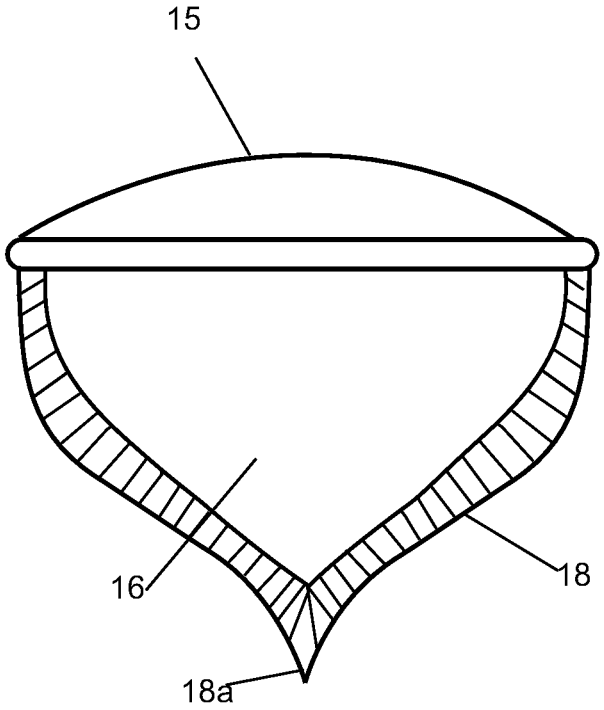
FIG. 4 is a cross-sectional view of the outrigger taken along the lines 4-4 of FIG. 2.

FIG. 4 is a cross-sectional view of the outrigger taken along the lines 4-4 of FIG. 2. Here, the door 15 with the storage compartment 13 and bulkhead 16 shown. Note that the hull 18 of the outrigger is formed as shown and has a buoyant shell. The form of the hull is that of a miniature canoe. The outrigger is formed with a keel 18*a* that adds to stability.

Figure 5:
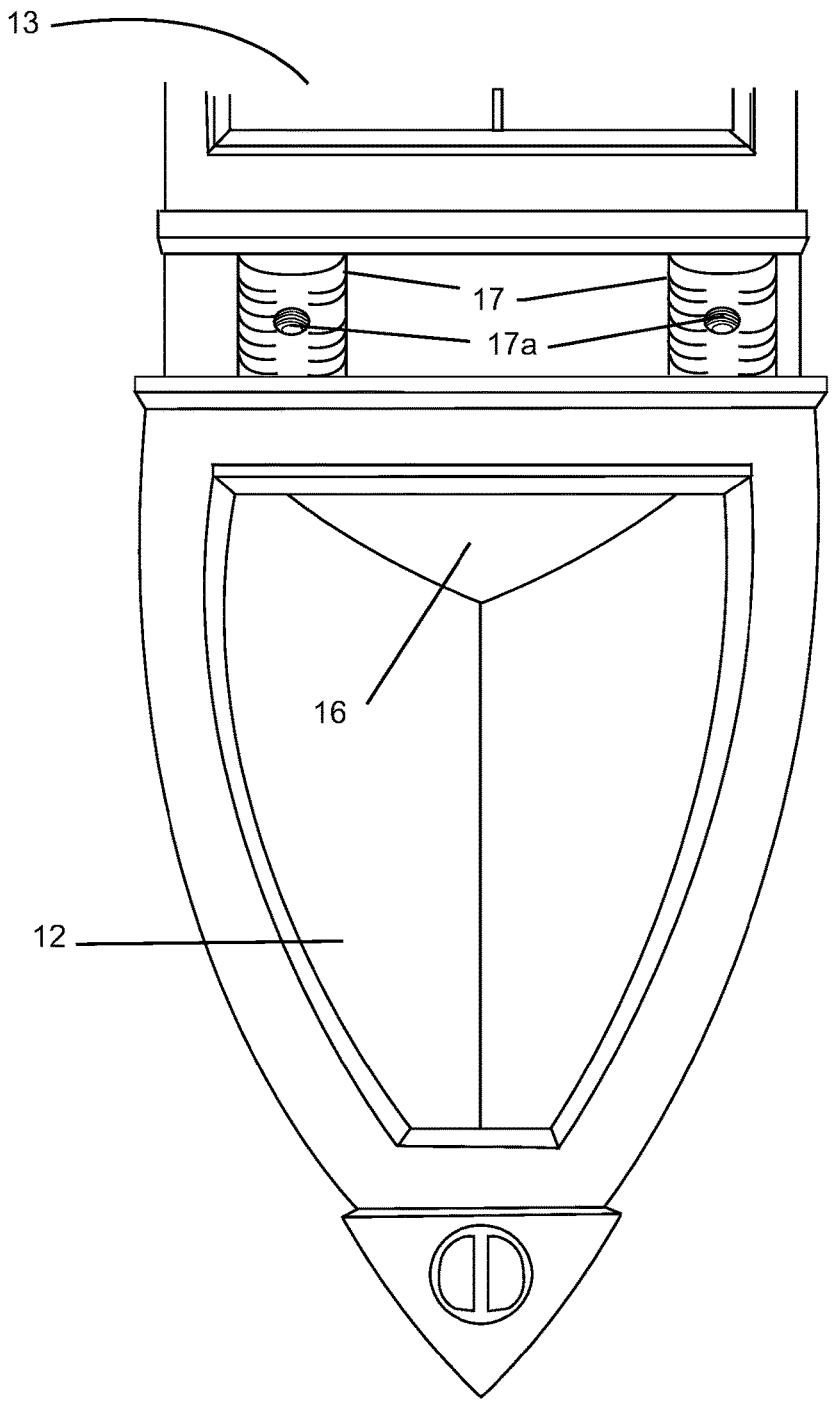
FIG. 5 is a detail view of one end of the outrigger with the storage door removed.

FIG. 5 is a detail view of one end of the outrigger with the storage door removed. In this view, additional details of the outrigger are shown. Here, compartment 12 is shown (and a small portion of compartment 13 as well). Note that the compartment has curved sidewalls that conform to the hull shape. Bulkhead 16 is also shown. Note that recesses 17 for the connector arms with the threaded holes 17*a*.

Figure 6:
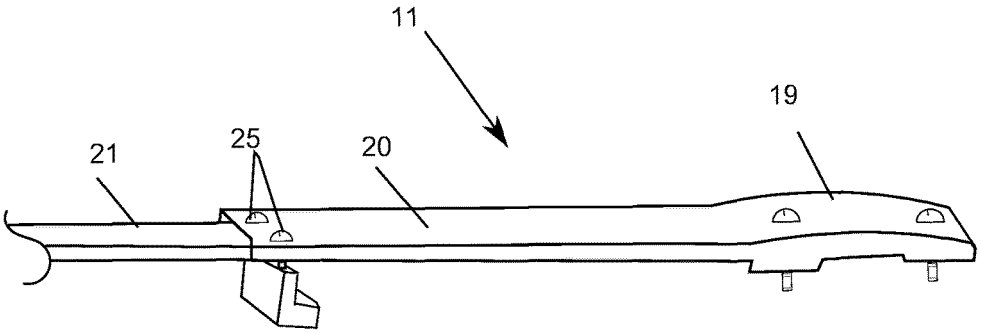
FIG. 6 is a perspective view of one of the arms that attaches the outrigger to the companion vessel.

As noted above, the outrigger 10 is connected to the canoe 100 (or other vessel) by connector arms 11. FIG. 6 is a perspective view of one of the arms that attaches the outrigger to the companion vessel. Each of the connector arms 11 consists of three portions. First, is the connector portion 19 that is used to bolt the connector arm to the outrigger. Second, is the extended portion 20 that adds length to the connector arm and spaces the outrigger apart from the canoe. The extended portion 20 also holds the telescoping portion 21, which forms the third portion of each connector arm 11. Note that a connector block 22 is attached below the extended portion as shown. A second connector block is attached to the end of the telescoping portion 21, as shown.

Figure 7:
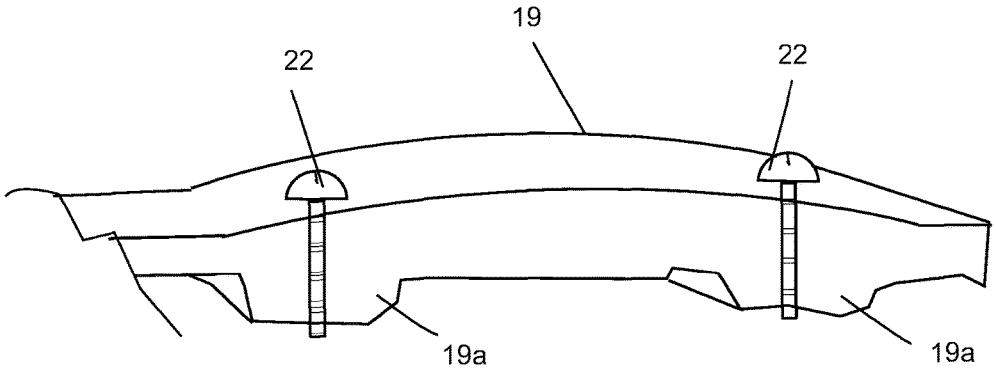
FIG. 7 is a perspective view of the connector portion of one of the arms that attaches to the outrigger.

FIG. 7 is a perspective view of the connector portion 19 of one of the arms that attaches to the outrigger. Note that the connector portion 11*a* has a curved upper surface that matches the curve of the storage compartments doors 15. The bottom of the connector portion has two formed portions 19*a* that fit into the recesses 17 on the outrigger. Two bolts 23 are used to secure the connector portion 19 to the outrigger, as discussed above.

Figure 8:
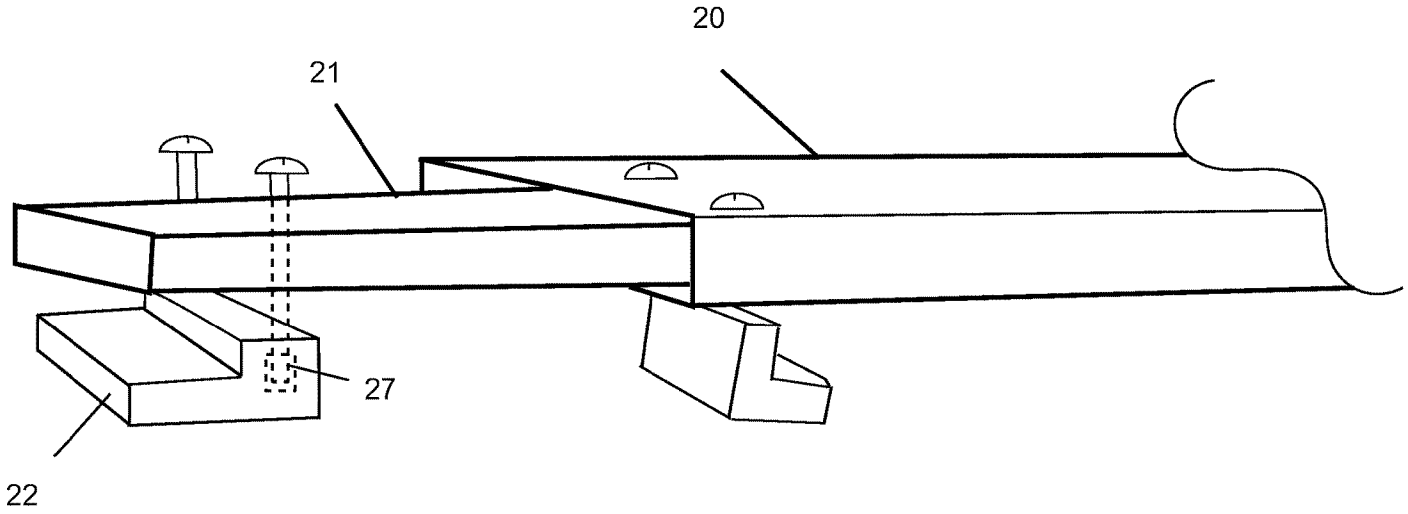
FIG. 8 is a perspective view of the telescoping portion of one of the arms that attaches to the outrigger.

FIG. 8 is a perspective view of the extended portion 20 and the telescoping portion 21 of one of the connector arms 11 that attaches to the outrigger. The extended portion 20 has an open end, as shown, that allows the telescoping portion 21 to fit within the extended portion 20. The telescoping portion 21 has a stop attached (not shown) to prevent it from being completely removed from the extended portion. Both the extended portion and the telescoping portion 21 of the connector arm have connector blocks 22 attached as shown. As discussed above and below, these connector blocks are used to secure the connector arm 11 to the canoe.

Figure 9:
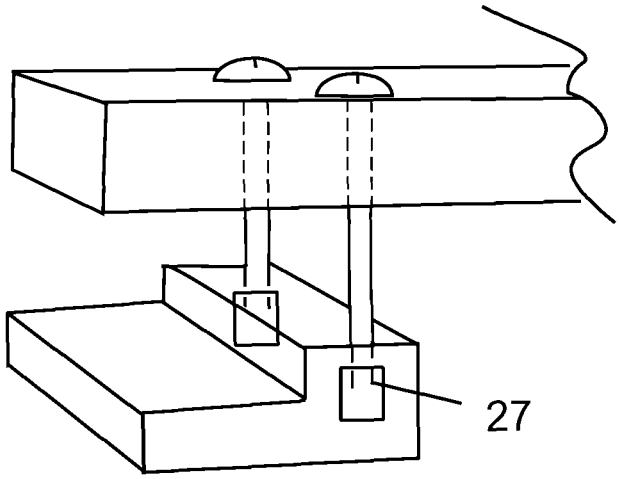
FIG. 9 is a perspective view of one of the connector blocks that attaches the arm to the companion vessel.

As shown in FIG. 9, the connector blocks 22 fit under the gunwales 101 of the canoe (in FIG. 9, this is the end of the telescoping portion, while the connector block on the extended portion's connector block faces the other way). Each connector block 22 has a back wall 22*a* and a front lip 22*b*. The front lip passes under the gunwale 101 and the back wall abuts against the gunwale when the connector block is installed. Bolts 25 and threaded inserts 27 are used to tighten the connector blocks tightly to the gunwale 101 (shown in dashed lines).

Figure 10:
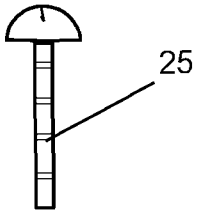
FIG. 10 is a side view of one of the bolts used to attach the connector arm to the vessel.
Figure 11:
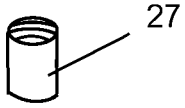
FIG. 11 is a detail view of a threaded insert, placed in the connector block that is used allow a bolt to secure the connector block to the vessel.

FIG. 10 is a side view of one of the bolts 25 used to attach the connector arm to the vessel. FIG. 11 is a detail view of a threaded insert 27, placed in the connector block that is used to secure the connector block to the vessel. This insert is simply a threaded cylinder embedded in the lower portion 23*b* of the connector blocks 23. Of course, any similar type of fastener can be used as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An outrigger with built-in storage capacity for use with a water vessel, comprising:

a) an outrigger shell having an outer hull and a hollow interior;

b) at least one cover, hingeably attached to said outrigger shell to cover said hollow interior;

c) a pair of connector arms, attached to said outrigger and extending outwardly therefrom to attach said outrigger to a pair of gunwales of another vessel; and d) at least one clamp attach to each of said pair of connector arms to secure said pair of connector arms to said vessel.

2. The outrigger of claim 1 wherein said hollow interior of said shell has at least one bulkhead formed therein.

3. The outrigger of claim 1 wherein each of said pair of connector arms has a telescoping portion.

4. The outrigger of claim 3 wherein each of said pair of connector arms has a connector block attached to said telescoping portion.

5. The outrigger of claim 1 wherein the vessel is selected from the group of canoes, rowboats and skiffs.

6. An outrigger with built-in storage capacity, for use with a water vessel having a width and a pair of gunwales, comprising:

a) an outrigger shell having an outer hull and a hollow interior;

b) at least one cover, hingeably attached to said outrigger shell to cover said hollow interior;

c) a pair of connector arms, each of said pair of connector arms having:

i) a connector portion that is used to attach the connector arm to the outrigger;

ii) an extended portion, having a distal end, that extends outwardly from said connector portion such that said outrigger is spaced apart from the water vessel;

iii) a telescoping portion, having a distal end, that extends outwardly from said extended portion such that said telescoping portion spans the width of said water vessel;

iv) a first connector block attached to the distal end of said extended portion such that said first connector block engages with one of said pair of gunwales; and v) a second connector block attached to the distal end of said telescoping portion such that said second connector block engages with the other of said pair of gunwales.

7. The outrigger of claim 6 wherein said hollow interior of said shell has at least one bulkhead formed therein.

8. The outrigger of claim 6 wherein the vessel is selected from the group of canoes, rowboats and skiffs.

9. The outrigger of claim 1 wherein the form of the outer hull of the outrigger shell has the shape of a miniature canoe.

10. The outrigger of claim 9 wherein the outrigger shell further includes a keel, extending downwardly from said outer shell.

11. The outrigger of claim 6 wherein the form of the outer hull of the outrigger shell has the shape of a miniature canoe.

12. The outrigger of claim 11 wherein the outrigger shell further includes a keel extending downwardly from said outer shell.

13. The outrigger of claim 1 further comprising:

a) a pair of hinged covers, hingeably attached to said outrigger shell.

14. The outrigger of claim 13 wherein:

a) one of said pair of hinged covers is attached to a forward portion of said outer hull;

b) the other of said pair of hinged covers is attached to an aft portion of said outer hull; and c) the at least one cover is attached to a middle portion of said outer hull.

15. The outrigger of claim 14 wherein:

a) each of said pair of hinged covers is attached athwart said outer hull; and b) said at least one cover is attached on one edge of said outer hull.

* * * * *